US012696925B2

(12) United States Patent
Singh

(10) Patent No.: US 12,696,925 B2
(45) Date of Patent: Aug. 4, 2026

(54) TRAY BOOKLET FOR SMOKABLES, ROLLING PAPER HOLDER AND ASSEMBLY

(71) Applicant: The New Ways B.V., Amsterdam (NL)

(72) Inventor: Rajdip Singh, Amsterdam (NL)

(73) Assignee: The New Ways B.V., Amsterdam (NL)

( * ) Notice: Subject to any disclaimer, the term of this patent is extended or adjusted under 35 U.S.C. 154(b) by 664 days.

(21) Appl. No.: 18/076,741

(22) Filed: Dec. 7, 2022

(65) Prior Publication Data

US 2023/0101749 A1 Mar. 30, 2023

Related U.S. Application Data

(63) Continuation of application No. PCT/NL2021/050396, filed on Jun. 23, 2021.

(30) Foreign Application Priority Data

Jun. 23, 2020 (NL) ..... 2025887

(51) Int. Cl.
*A24C 5/44* (2006.01)
*A24D 1/02* (2006.01)
*A24F 17/00* (2006.01)

(52) U.S. Cl.
CPC ..... *A24D 1/022* (2013.01); *A24C 5/44* (2013.01); *A24F 17/00* (2013.01)

(58) Field of Classification Search
CPC ..... A24C 5/44; A24D 1/022; A24F 17/00
See application file for complete search history.

(56) References Cited

U.S. PATENT DOCUMENTS

2015/0090275 A1 4/2015 Kesselman et al.
2016/0128382 A1 5/2016 Staiano et al.
(Continued)

FOREIGN PATENT DOCUMENTS

EP 2387891 A1 11/2011
EP 2440075 A1 4/2012
(Continued)

*Primary Examiner* — Cynthia Szewczyk
(74) *Attorney, Agent, or Firm* — Peacock Law P.C.; Justin R. Muehlmeyer; Daniel J. Berenger-Russell

(57) ABSTRACT

An assembly of a tray booklet and rolling paper holder, the individual booklet and individual rolling paper holder. The booklet is suitable for smokables comprising a compostable cover body comprising a sheet defining an inner surface and an outer surface, and smoking paraphernalia arranged on the inner surface. The sheet includes first lines of weakness for the cover body to fold along from an open configuration into a closed configuration and vice versa. In the closed configuration the sheet encloses the smoking paraphernalia. In the open configuration the smoking paraphernalia are uncovered. The sheet includes at least one second line of weakness for the body to fold along from an open configuration into a channel configuration and vice versa. In the channel configuration the sheet forms a first and a second upstanding ondulation defining a holding channel therebetween for holding the smokables. The rolling paper holder is folded from a single sheet cutout such that the holder defines an inner volume for holding trapezoid rolling papers therein in a stack. The cutout comprises lines of weakness arranged such that they define a plurality of trapezoid areas and along which lines of weakness the cutout is folded into the holder. The plurality of trapezoid areas include a trapezoid outlet provided with a slit for allowing a rolling paper closest to the outlet area to be removed from the stack therethrough, and a trapezoid base forming a base of the holder opposite the trapezoid outlet area.

13 Claims, 20 Drawing Sheets

(56) References Cited

U.S. PATENT DOCUMENTS

| | | | | |
|---|---|---|---|---|
| 2017/0055568 | A1* | 3/2017 | Sinclair, Jr. | A24C 1/30 |
| 2019/0183165 | A1* | 6/2019 | Haddad | B65D 5/2042 |
| 2020/0113229 | A1 | 4/2020 | Barry | |
| 2020/0260781 | A1* | 8/2020 | Babi | A24D 1/022 |
| 2020/0268045 | A1* | 8/2020 | Partouche | A24F 23/00 |

FOREIGN PATENT DOCUMENTS

| | | | |
|---|---|---|---|
| WO | 2019068065 | A2 | 4/2019 |
| WO | 2021262000 | A1 | 12/2021 |

* cited by examiner

TRAY BOOKLET FOR SMOKABLES, ROLLING PAPER HOLDER AND ASSEMBLY

CROSS-REFERENCE TO RELATED APPLICATIONS

This application is a continuation application of International Patent Application No. PCT/NL2021/050396, titled "TRAY BOOKLET FOR SMOKABLES, ROLLING PAPER HOLDER AND ASSEMBLY", filed on Jun. 23, 2021, which claims priority to and the benefit of Netherland Patent Application No. 2025887, titled "TRAY BOOKLET FOR SMOKABLES, ROLLING PAPER HOLDER AND ASSEMBLY", filed on Jun. 23, 2020, and the specification and claims thereof are incorporated herein by reference.

BACKGROUND OF THE INVENTION

Field of the Invention

The invention relates to a tray booklet for smokables, rolling paper holder and an assembly thereof.

Hand-rolled herbs for smoking allow the smoker to customize his or her cigarettes, cigars, and the like to his or her individual taste. Thus, despite the abundance of mass-produced cigarettes, smokers continue to enjoy rolling their own cigarettes because the cigarettes can be individualized to the smokers taste. The size, length, thickness, and density of the cigarette can be varied for each cigarette rolled. What is more, the smoker can vary the mixture of tobacco, herbs, or other combustible vegetable substance used in the cigarette in order change the taste or effect of the smoke. (The term "herbs" is used herein to refer to any combustible vegetable substance used for smoking; the term "cigarette" is used herein to refer to any tube-like collection of rolled and packed herbs for smoking; and the term "rolling paper" is used herein to refer to any type of plant leaf or paper that can be used to hold herbs).

Due to the difficulties in grinding, separating, rolling, and packing cigarettes by hand, a variety of implements and devices have been developed in order to aid in the rolling process. Some relatively simple devices, commonly referred to as "rolling mats," or "rolling trays" allow the user to lay a cigarette paper flat, add herbs, and roll the cigarette and herbs into a cylindrical shape. Such rolling mats, much like paraphernalia, may be less convenient for a user to carry around separately. Sometimes paraphernalia may be lost or not at hand at a time when the smoker wishes to roll a cigarette.

BRIEF SUMMARY OF THE INVENTION

Embodiments of the present invention are directed toward overcoming the above shortcomings, aim to improve the rolling experience or at least provide an alternative.

Embodiments of the invention will hereinafter be further elucidated with reference to the drawings of exemplary embodiments of a booklet and a holder according to the invention which are not limiting as to the appended claims.

To this end, embodiments of the present invention are directed to a tray booklet for smokables, such as tobacco and/or *cannabis* comprising a compostable cover body comprising a sheet defining an inner surface and an outer surface. The booklet further comprises smoking paraphernalia arranged on the inner surface of the sheet. These paraphernalia may be provided in respectable holders which fixedly connected to the inner surface of the sheet. The sheet is provided with first lines of weakness for the cover body to fold along from an open configuration into a closed configuration and vice versa. In the closed configuration the sheet encloses the smoking paraphernalia. In the open configuration the smoking paraphernalia are uncovered. The sheet is further provided with at least one second line of weakness for the body to fold along from an open configuration into a channel configuration and vice versa, and wherein in the channel configuration the sheet forms a first and a second upstanding ondulation defining a holding channel therebetween for holding the smokables.

Optionally, the booklet comprises a stick element. The sheet comprises two slits extending in a perpendicular direction to the first lines of weakness. The stick element is secured to the body by simultaneously extending through the two slits. This provides the user with a convenient means to store a supporting tool, such as a stick element, for constructing a cigarette from the paraphernalia and the smokable. A possible addition may be that each slit extends from one line of the first lines of weakness to another line of the first lines of weakness. This is especially handy when the slits are, in use, located on a broad edge of the booklet, because this allows the stick to be seen without the opening of the package by the user.

Further to the invention, each of the first and a second upstanding ondulations, also known as a crested wave, may be triangular in cross-section, which can be understood to mean an upside-down V. That is to say when the booklet is in the channel configuration, or a tray configuration. A benefit is that this allows a user to adjust the upper width of the channel while the inner surfaces of the channel are supported against falling outwards. Optionally, the holding channel is an inverted trapezoid or V-shaped in medial cross-section.

A user may wish to secure the booklet against opening. To this end a magnetic seal, for reversibly securing the cover body in the closed position may be provided.

Optionally, in the open, and/or closed, position the first and the at least one second line of weakness are substantially parallel in 3D space and distributed along the inner and/or outer surface of the sheet. In this manner the body is allowed to unfold in such a manner that the channel is at least partially horizontal. This beneficially prevents paraphernalia and smokable from moving along the channel under the influence of gravity.

In extension, the smoking paraphernalia may comprise at least one of filters and rolling papers. It is possible for the rolling papers to be provided as a stack of trapezoid rolling papers in a holder.

Optionally, the sheet is further provided with third lines of weakness for the body to fold along from the channel configuration into a tray configuration and vice versa, wherein in the tray configuration opposite ends of the holding channel each form an upstanding wall. This beneficially prevents spilling of smokables when the booklet is tilted.

In extension of the before mentioned the length of the opposite ends of the holding channel may be chosen such that each of their lengths is substantially half the width of the tray booklet, and wherein each of the opposite ends is also less than half of the total length of the holding channel, that is to say less than half the length of the booklet. This allows the booklet to be pinch closed while maintaining a tray configuration. Preferably between the opposite ends are chosen so as to be 15-35% of the total length of the holding channel 15. This allows for a minimum volume of the tray to not be determined by the content but by the arrangement upon pinch closing.

In another embodiment the sheet 6 defines four surfaces separated by three pairs of first lines of weakness 11 defining four separate portions (P1, P2, P3, P4), and wherein the first portion comprises the second lines of weakness 13 for the body to fold along from an open configuration into a channel configuration, and wherein the pairs of first lines of weakness 11 separating the first portion P1 from the second portion P2 are spaced 1,5-3,0 times closer together, preferably twice as close together, than the first lines of weakness 11 separating the second portion P2 from the third portion P3. This beneficially allows the tray to be folded between two portions, so as to protect it against deformation. The first ondulation would in this embodiment not be present.

Alternatively, the body further comprises two lateral flaps each defining an inner flap surface and an outer flap surface. Each of the two lateral flaps is integral with the sheet. For each flap a first part of the inner flap surface is affixed, such as by glue, to a channel facing surface of the first ondulation, and wherein fora second part of the inner flap surface is affixed, such as by glue, to a channel facing surface of the second ondulation, and wherein a third part of the of the inner flap surface is unaffixed. The two flaps are provided with third lines of weakness for the body to fold along from the channel configuration into a tray configuration and vice versa, and wherein in the tray configuration the two flaps extend away from each other for forming an upstanding wall. This also beneficially prevents spilling of smokables when the booklet is tilted. Optionally and additionally, each of the two flaps is a semi-circle. Other shapes are also possible.

Further optionally, the third lines of weakness are provided in the third part of the of the inner flap surface of each of the two flaps. It may even further be possible that the third lines of weakness each extend to meet the second line of weakness. This allows for a smoother folding experience of the booklet.

To the end of improving the cigarette rolling experience the present invention further presents a rolling paper holder folded from a single sheet cutout such that the holder defines an inner volume for holding trapezoid rolling papers therein in a stack. The cutout comprises lines of weakness arranged such that they define a plurality of trapezoid areas and along which lines of weakness (107) the cutout is folded into the holder. The plurality of trapezoid areas comprises a trapezoid outlet provided with a slit for allowing a rolling paper closest to the outlet area to be removed from the stack therethrough. The plurality of trapezoid areas further comprises a trapezoid base forming a base of the holder opposite the trapezoid outlet area.

Optionally, the plurality of trapezoid areas further comprises a trapezoid cover arranged as a flap for reversibly covering an outer face of the trapezoid outlet area. This beneficially prevents undesired displacement of rolling papers. Optionally each of the plurality of trapezoid areas has substantially equal dimensions.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims

BRIEF DESCRIPTION OF THE SEVERAL VIEWS OF THE DRAWINGS

Further to the invention there is provided an assembly of the tray booklet as described herein above and the rolling paper holder as described herein above. The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings:

FIGS. 2A-2D each show a perspective view of the tray booklet according to the first embodiment, in various stages between the open and closed configuration, wherein FIG. 2D is the closed configuration;

DETAILED DESCRIPTION OF THE INVENTION

Figure 1:
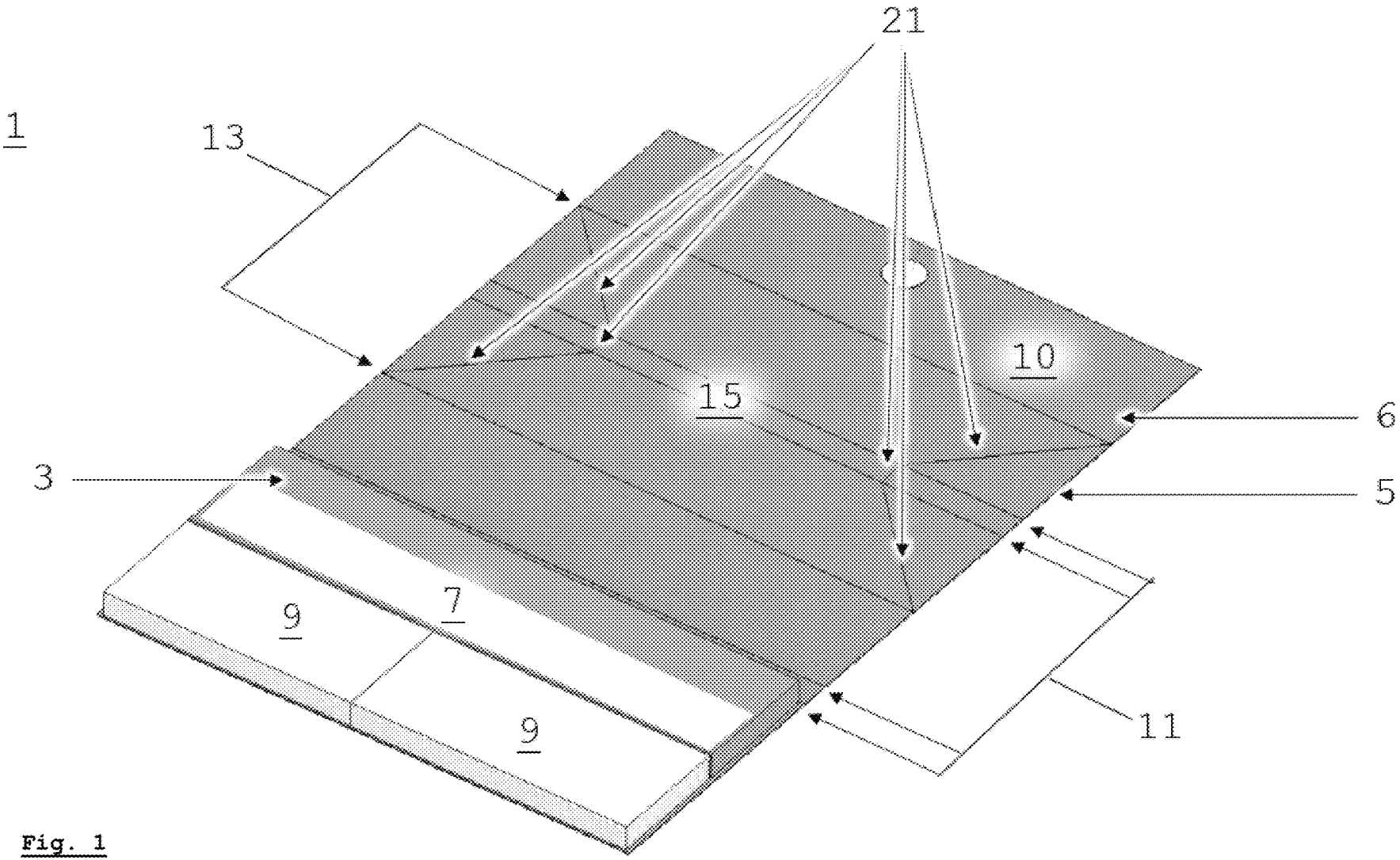
FIG. 1 shows a perspective view of a tray booklet, according to a first embodiment according to the present invention, in an open configuration.

FIG. 1 shows a tray booklet 1 for smokables (not shown, but customary) according to a first embodiment of a first aspect of the invention. Such smokables can be tobacco, *cannabis* or a combination thereof. The booklet 1 has a compostable cover body 5. In this example, the body is made out of cardboard. However, other compostable materials, such as Polylactic acid (PLA) may also be used. The body can be seen to consist of a sheet 6, in particular a square cardboard sheet. The sheet has an inner surface 10 and other side an outer surface 12. This outer surface can best be seen in FIGS. 2B-2D, whereas in the perspective of FIG. 1 only the inner surface is visible. The booklet further has smoking paraphernalia 7, 9. In this example the paraphernalia are filters 7 and rolling papers 9 which are arranged on the inner surface 10. The rolling papers are in this example provided as a stack of papers in a conventional holder 3. The papers are arranged on the inner surface via the conventional holder 3 which may be glued to the inner surface. This holder may alternatively also be a holder according to a second aspect of the invention. The sheet 6 has first lines of weakness 11 for the cover body 5 to fold along from an open configuration into a closed configuration and vice versa. These first lines of weakness may, much like any other lines of weakness mentioned herein below also separate from this embodiment, be formed by creasing the sheet. Along these lines 11 the body is able to fold from an open configuration into a closed configuration and vice versa. In the closed configuration the sheet 6 encloses the smoking paraphernalia. Encloses is here intended to be read as covers or wraps around. The sides may be left uncovered. The closed configuration can be seen in FIG. 2D. In the open configuration the smoking paraphernalia are uncovered. The open configuration can be seen in FIG. 1.

Figure 2A:
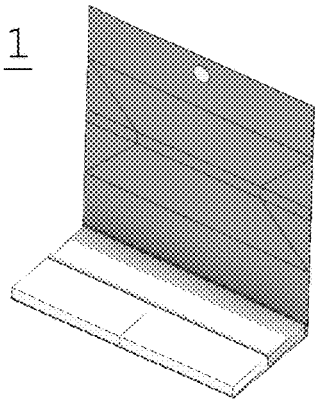
Figure 2C:
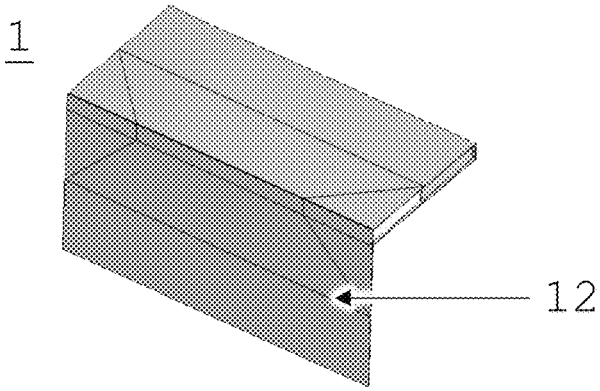
Figure 2B:
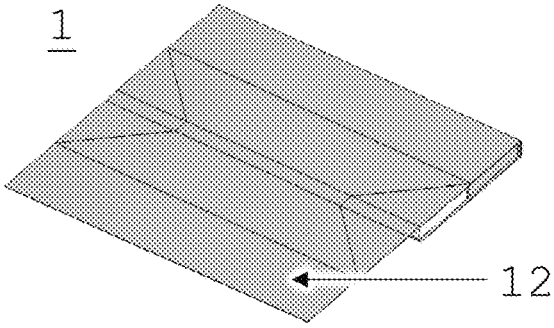
Figure 2D:
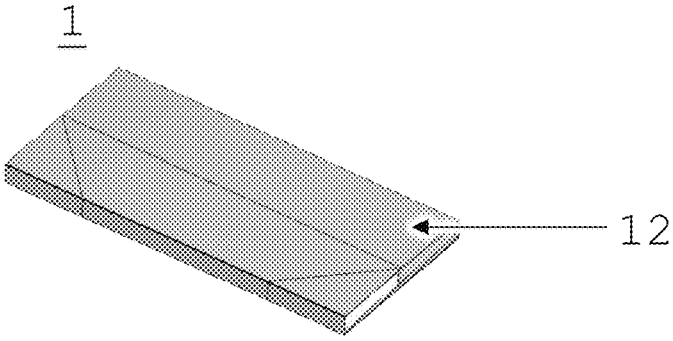
Figure 3:
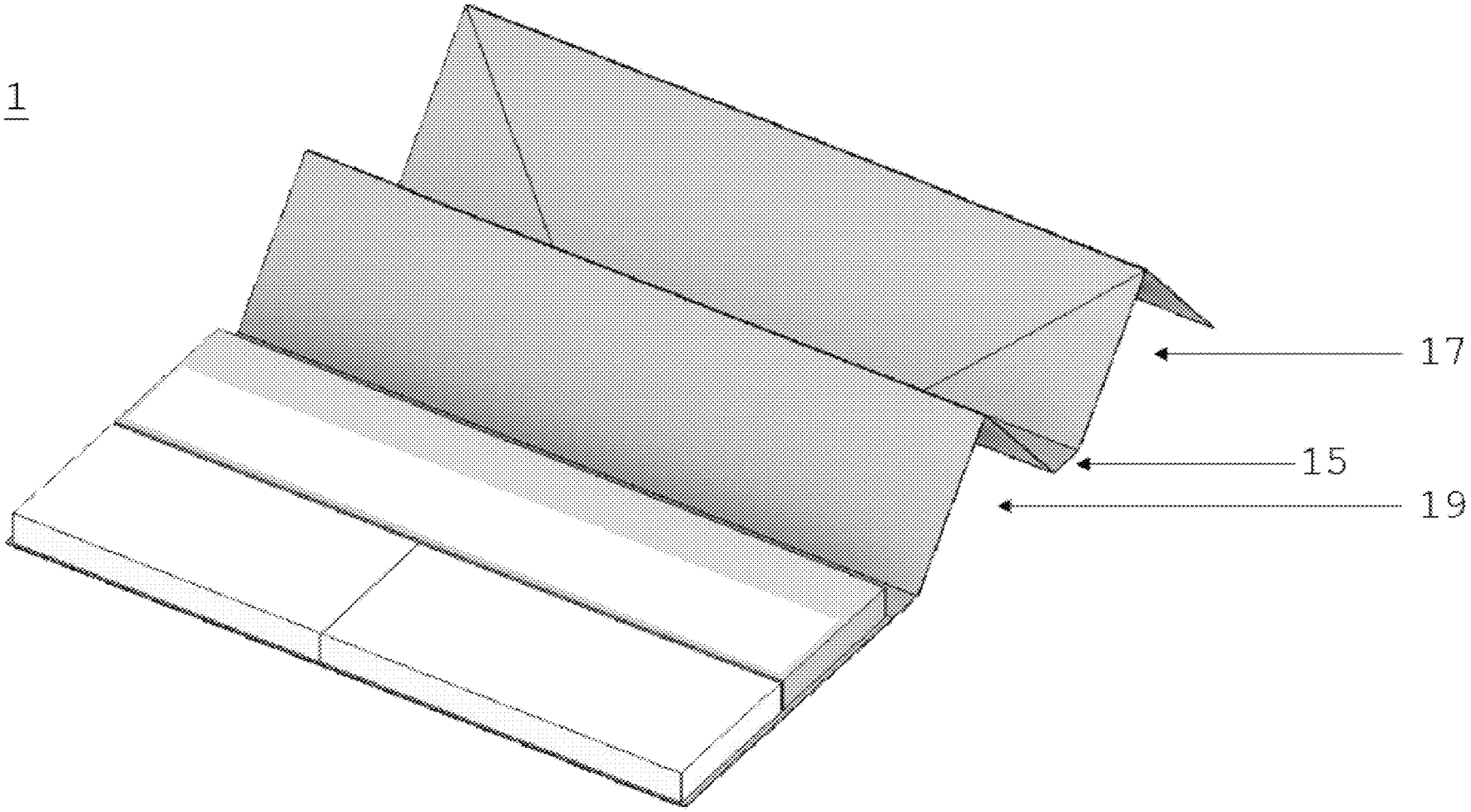
FIG. 3 shows a perspective view of the tray booklet, according to the first embodiment, in a channel configuration.
Figure 3A:
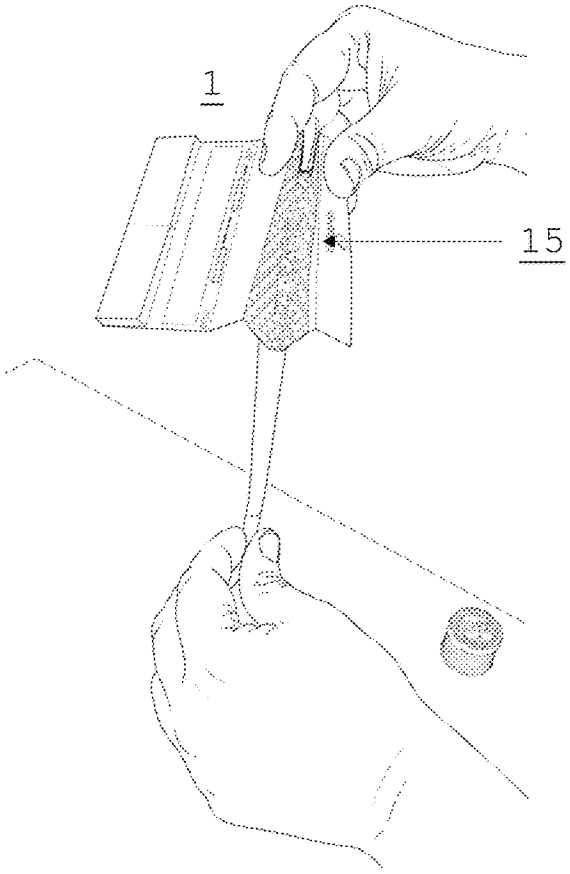
FIGS. 3A, 3B and 3C are a series of illustrations showing the use of the tray booklet in the channel configuration.
Figure 3B:
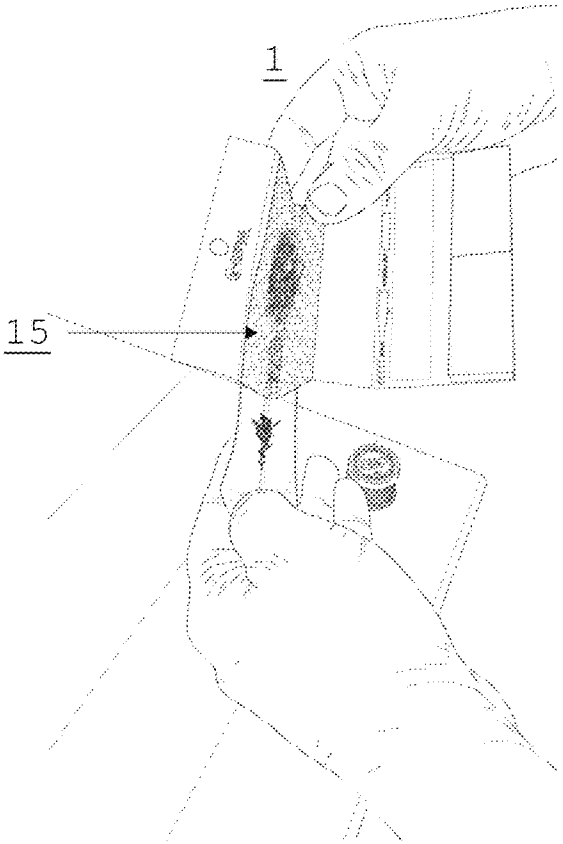
Figure 3C:
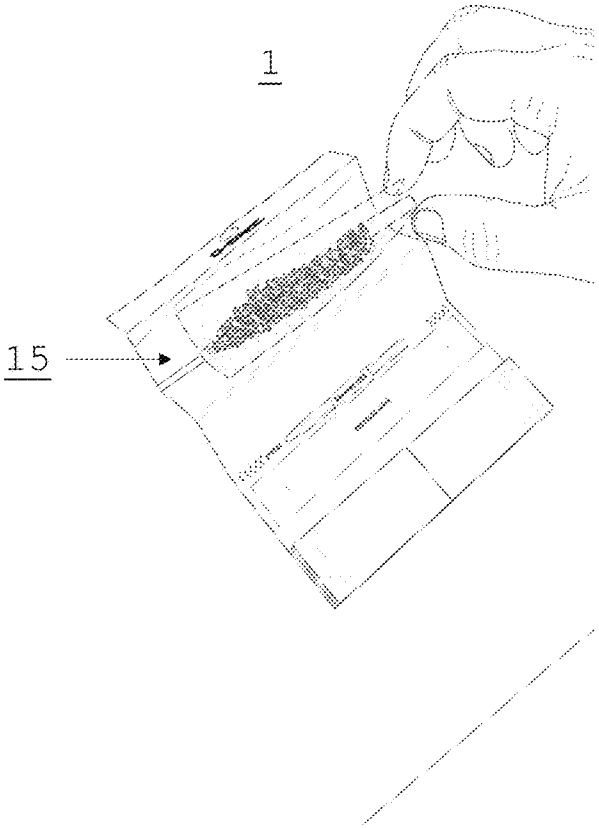

FIGS. 2A, 2B and 2C show transitory configurations between the open configuration and the closed configuration. The sheet 6 is further provided with at least one, in this case two second lines of weakness 13, for the body to fold along from an open configuration into a channel configuration and vice versa. This channel configuration is shown in FIG. 3 where it can be seen that the sheet forms a first upstanding ondulation 17 and second upstanding ondulation 19. That is to say, the sheet 6 is pleated to form a first crested wave crest 17 and a second crested wave 19. The term upstanding ondulation may for the purpose of this patent be taken to mean crested wave. The first and second crested waves define between themselves a holding channel 15 for holding the smokables. The crested waves beneficially act as a self-supporting structure. The weight of the paraphernalia may in this example prevent the booklet from shifting on a supporting surface such as a table. This aids in keeping the booklet from moving out of its configuration on its own. In use, a user may place a single rolling paper within the channel. Subsequently the user may place the smokable, and optionally a filter, on top of said single paper. The channel will keep the filter and smokable in position where after the user is able to roll the positioned items into a cigarette. In the open configuration as shown in FIG. 1, the first and second lines of weakness are substantially parallel in 3D space and distributed along the inner and/or outer surface of the sheet. The same can be said for the body 5 assuming the closed configuration as shown in FIG. 2D and the channel configuration as shown in FIG. 3. FIG. 3A shows the use of the booklet 1 in the channel configuration where the channel 15 acts as a slide or funnel for filling an individual rolling paper. Other uses are also shown in FIG. 3B where the channel 15 acts as a slide or funnel for filling a cone. The ondulations allow the user to pinch vary the size of the funnel allow the user to adjust the channel to the diameter of the cone; thus, preventing spillage. In FIG. 3C a use is shown wherein a rolling paper is placed within the channel first and a smokeable material, such as tobacco, and a filter tip, are subsequently placed onto the paper within the channel. All in all, the present invention allows for any number of techniques for rolling a cigarette, such as a conical cigarette, to be applied by a user. This allows the booklet to be very user friendly.

FIG. 1 further shows that the sheet 6 is has third lines of weakness 21 for the body to fold along from the channel configuration into a tray configuration and vice versa. These third lines of weakness 21 are an entirely optional feature. They may be provided such that the body 5 of the booklet 1 can fold into a configuration hereinafter referred to as a tray configuration.

Figure 4:
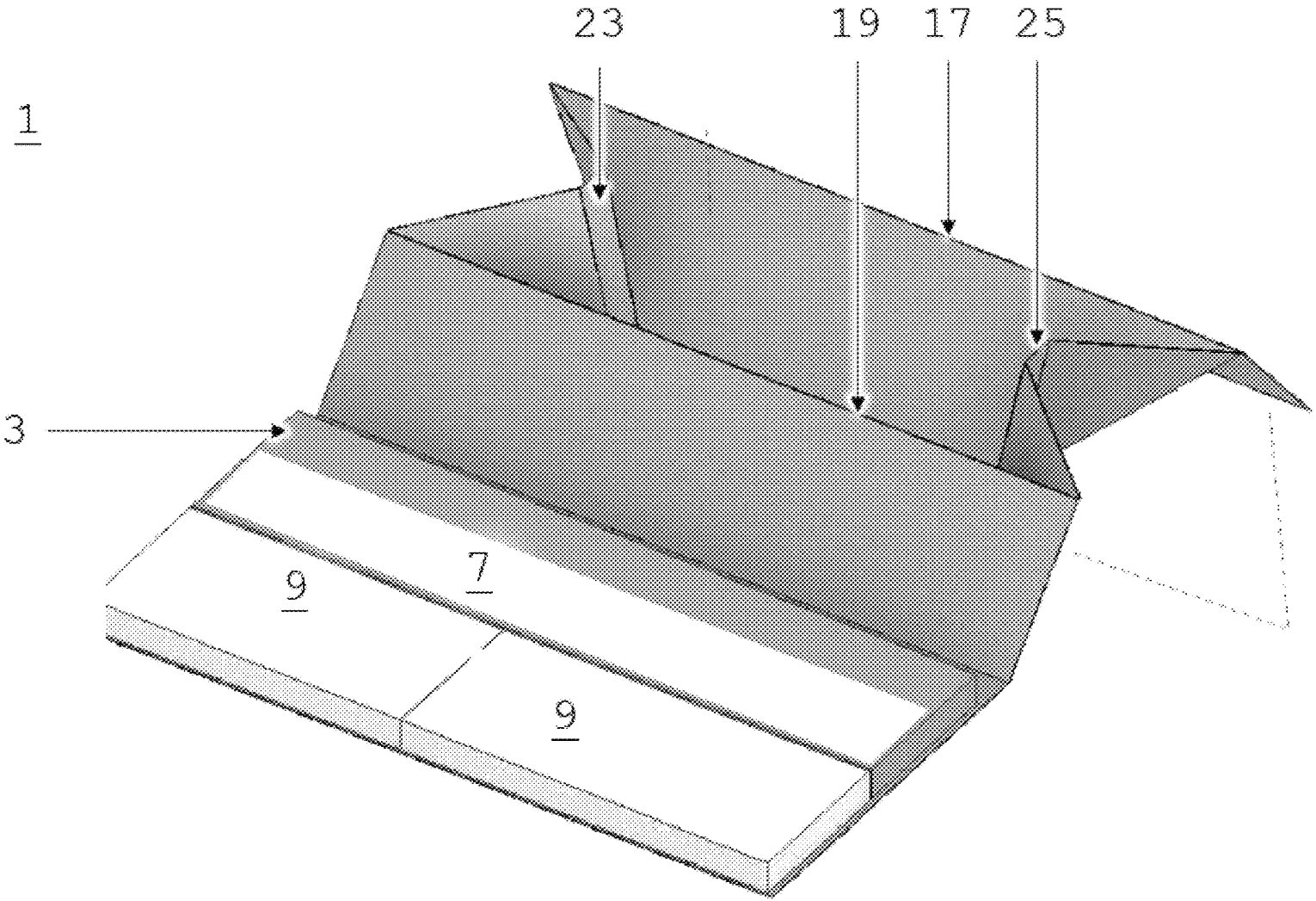
FIG. 4 shows a perspective view of the tray booklet, according to the first embodiment, in a tray configuration.

FIG. 4 is a perspective view of the booklet 1. The body 5 of the booklet 1 is here shown to have assumed the tray configuration. In this example the tray configuration is defined by opposite ends 23, 25 of the holding channel 15 each forming an upstanding wall. These opposite ends are folded towards each other along the third lines of weakness 21. This configuration prevents any materials placed in the channel 15 from falling out of the side of the booklet.

Figure 5:
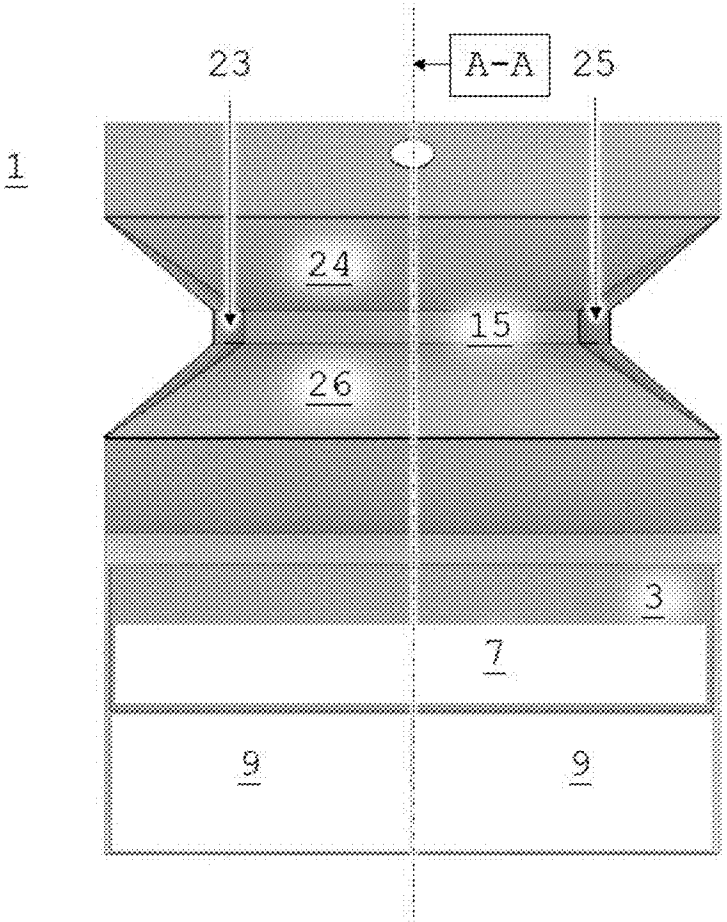
FIG. 5 shows a top view of the tray booklet, according to the first embodiment, in the tray configuration.

FIG. 5 shows a top-down view of the booklet 1 in the same configuration as shown in FIG. 4. It can be seen that in this configuration the channel 15 and inner surfaces of the 24, 26 upstanding ondulations define a cup volume. The upstanding walls 23, 25 formed by the channel 15 also co-define said cup volume.

Figure 6:
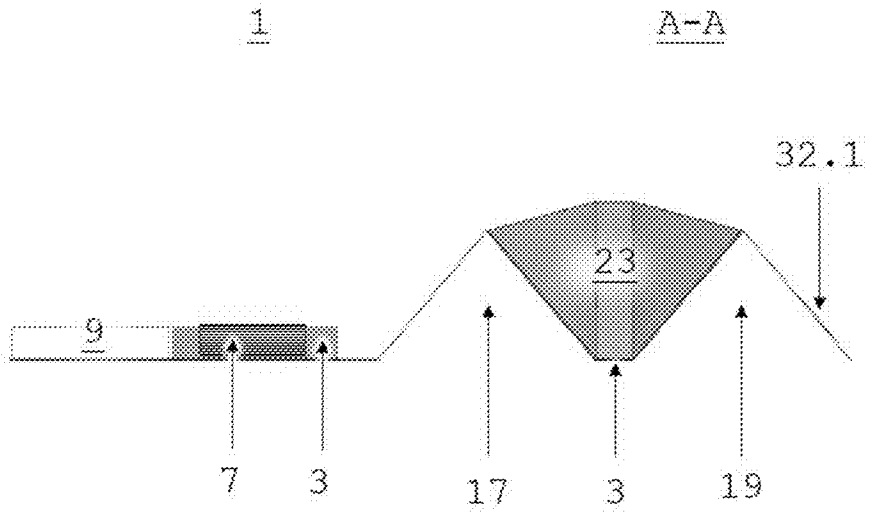
FIG. 6 shows a cross-sectional view of the tray booklet, according to the first embodiment, in the tray configuration.

FIG. 6 shows a medial cross-section A-A of the booklet as shown in FIG. 5. Here it can be seen that each of the first and a second upstanding ondulations 17, 19 is triangular. That is to say each of the upstanding ondulations is, in cross-section, an upside-down V-shape.

Figure 7:
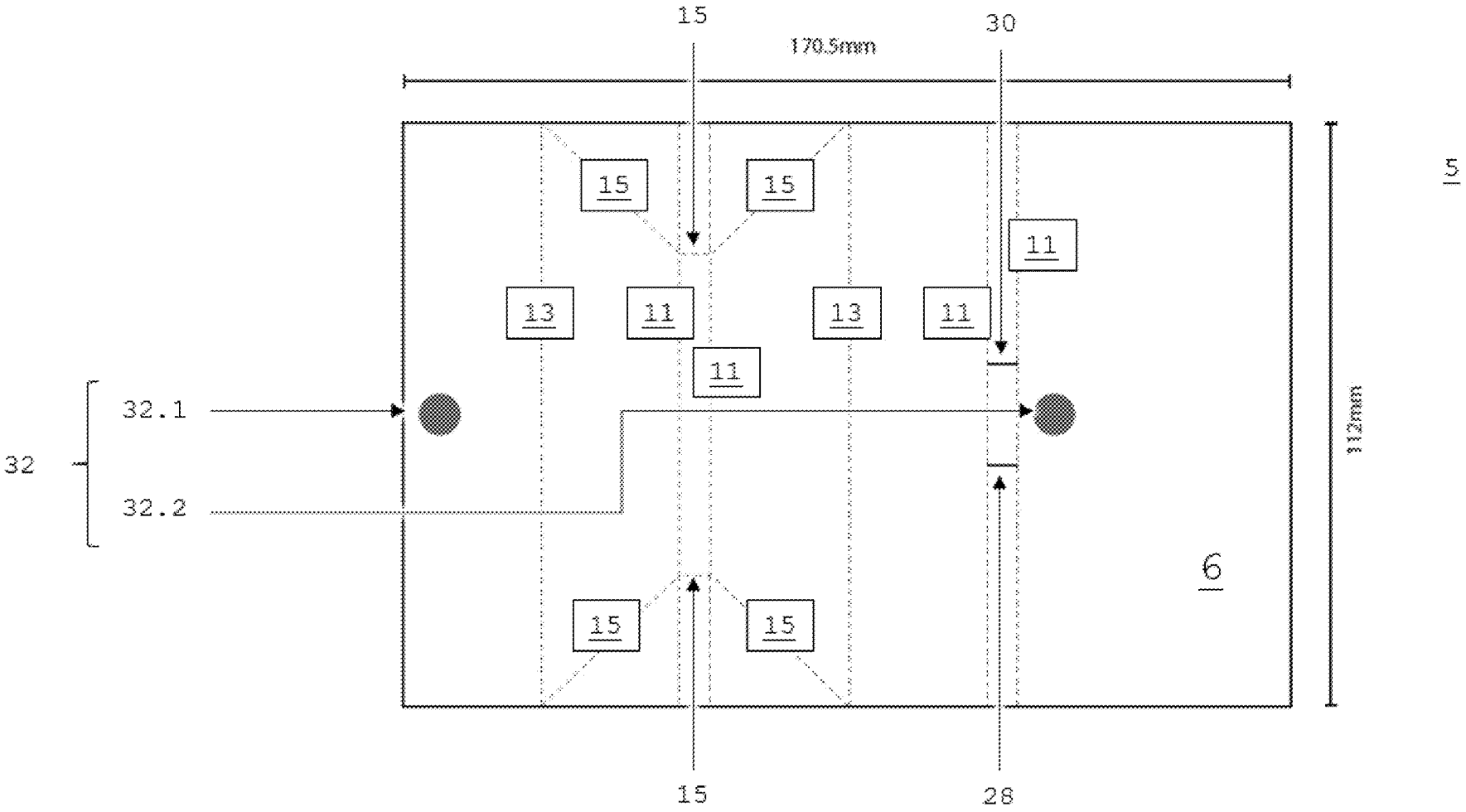
FIG. 7 shows a top view of the sheet of the cover body of the tray booklet according to the first embodiment.

FIG. 7 shows a top view of the sheet 6 from which the body 5 is formed laid out flat. In this example it is shown that the sheet 6 is 170.5 mm in length and 112 mm in diameter. In order to accommodate a stick element (not shown, but customary) the sheet 6 may be provided with two slits 28, 30. These slits can be seen to extend in a substantially perpendicular direction to the first lines of weakness 11. Although the slits are shown to be perpendicular, it is noted that any angle between 45-90 degrees with respect to the first lines of weakness 11 will also be sufficient. By making the slits parallel to each other and substantially perpendicular to the first lines of weakness 11 the structural integrity of the body is benefitted. Namely, should the slits tear, such tearing is less likely to propagate in a way that the tearing slits meet. In this example the stick element can be secured to the body by simultaneously extending through the two slits 28, 30. The slits are optionally equal in length as shown in FIG. 7. The stick element can be understood to simply be a stick. This stick can, in any of the embodiments of the invention, formed as a biodegradable pick, such as a bamboo pick, a wooden pick. The stick element preferably has a length that is smaller than the 112 mm, or the width of the sheet, and larger than the distance between the two slits. The width or diameter of the stick is chosen such that it does not exceed the length of the slits. To this end tearing of the slits is largely prevented. Each slit of the two slits 28, 30 can be seen to extend from one line of the first lines of weakness to another line of the first lines of weakness. This is optional. FIG. 7 further shows an optional magnetic seal 32, for reversibly securing the cover body 5 in the closed configuration as per FIG. 2D. The magnetic seal 32 comprises two cooperating ferromagnetic elements 31.1, 31.2. That is to say, a magnetic button, or strip, 31.1 and a cooperatively responsive button, or strip, 31.2 to the magnetic button or strip 31.1. The cooperatively responsive button, or strip, 31.2 can be a ferrous strip or a magnet like the magnetic button, or strip, 31.1. In the latter situation the magnets are arranged to line up and attract each other when the body 5 assumes a closed configuration. The magnetic seal 32 is fixedly attached to the sheet 6 of the body 5. In this example the cooperating ferromagnetic elements are glued to, or furnished into, or otherwise fixedly attached to the sheet 6. The sheet that forms the body of the tray booklet is in this example made of 250 grams per square centimetre solid bleached board paper. This paper type allows for folded structures, such as the tray, to retain their shape without additional elements, as opposed to tray booklets which require the use of rubber bands to retain the shape of their folded structures. The choice of paper is an option that is also separately implementable from this example.

Figure 14A:
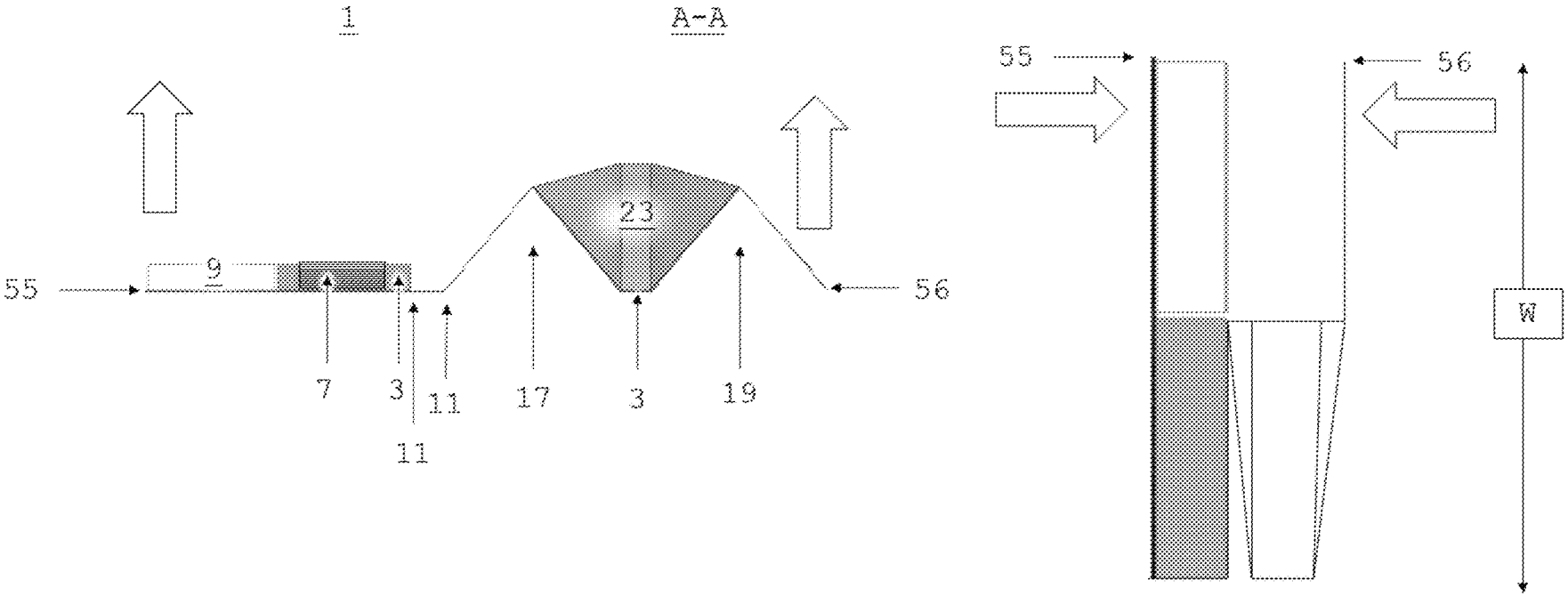
FIG. 14A shows another folding position of the tray booklet as seen from FIGS. 1-7.
Figure 14B:
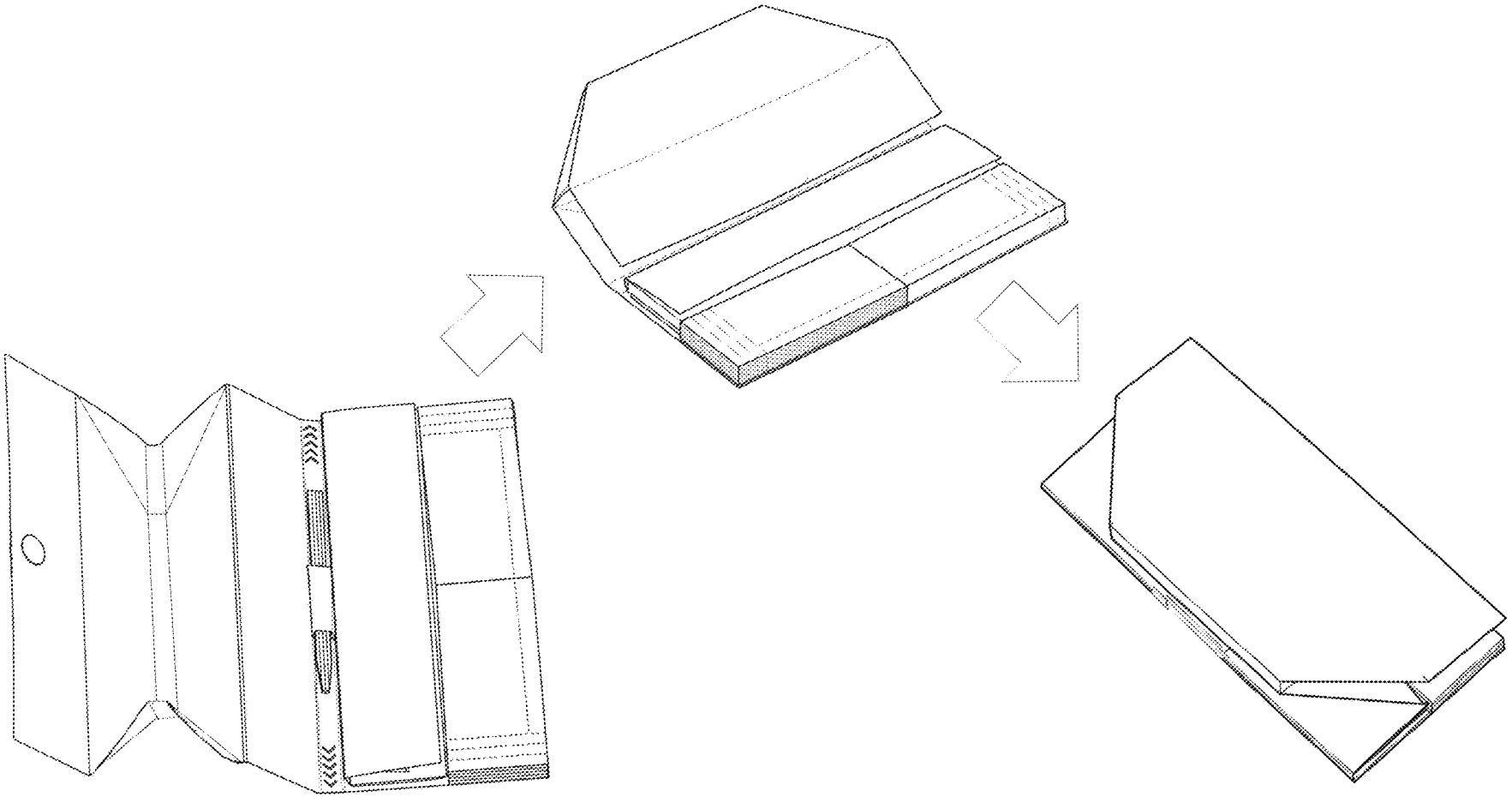
FIG. 14B shows the tray booklet as per FIG. 14A in various folded states.

FIG. 14A shows that the tray booklet 1 in a second closed configuration, but one in which the tray remains configured. It is sometimes the case that a booklet user is interrupted in the process of rolling a smokable. Or that a user may wish to relocate once he or she has started using the tray. In this invention the user may simply, starting from the tray configuration as showing in FIG. 5, lift the two lateral edges 55, 56 upwards. The user may then proceed to pinch these edges together and move the tray elsewhere while keeping the content of his tray secure. The previous benefit is obtained by choosing the length of the opposite ends 23, 25 of the holding channel 15 such that their length are substantially half the width W of the tray booklet. This also prevents the upstanding walls 23, 25 from moving inward and touching each other, thus potentially deforming the tray structure. FIG. 14B shows that the process of moving the booklet into the second closed configuration prevents any folds from being expressed across the entire length of the outer face of the booklet. This means that any advertising images or logos are preserved even after many uses of the booklet.

Figure 8:
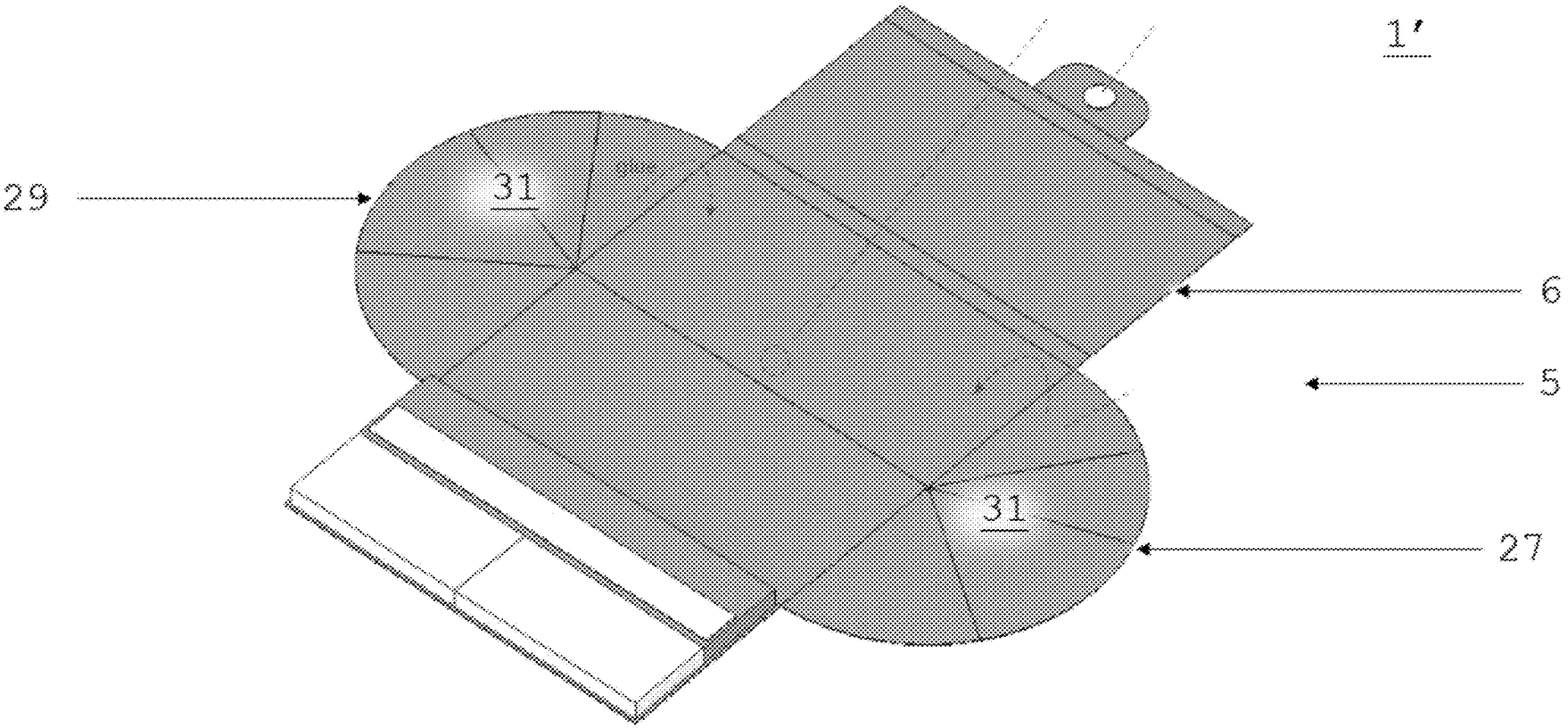
FIG. 8 shows a perspective view of a tray booklet according to a second embodiment of the present invention.

FIG. 8 shows a tray booklet 1' for smokables (not shown, but customary) according to a second embodiment of the first aspect of the invention. Hereinafter only differences with the tray booklet 1 according to the first embodiment will be discussed. Features shared across the embodiments are provided with the same reference numbers. In this embodiment the body 5 additionally has two lateral flaps 27, 29 each defining an inner flap surface 31 and an outer flap surface. This outer flap surface is not visible in FIG. 8, but can be understood to be the opposite surface to the inner surface 31 of any flap.

Figure 9:
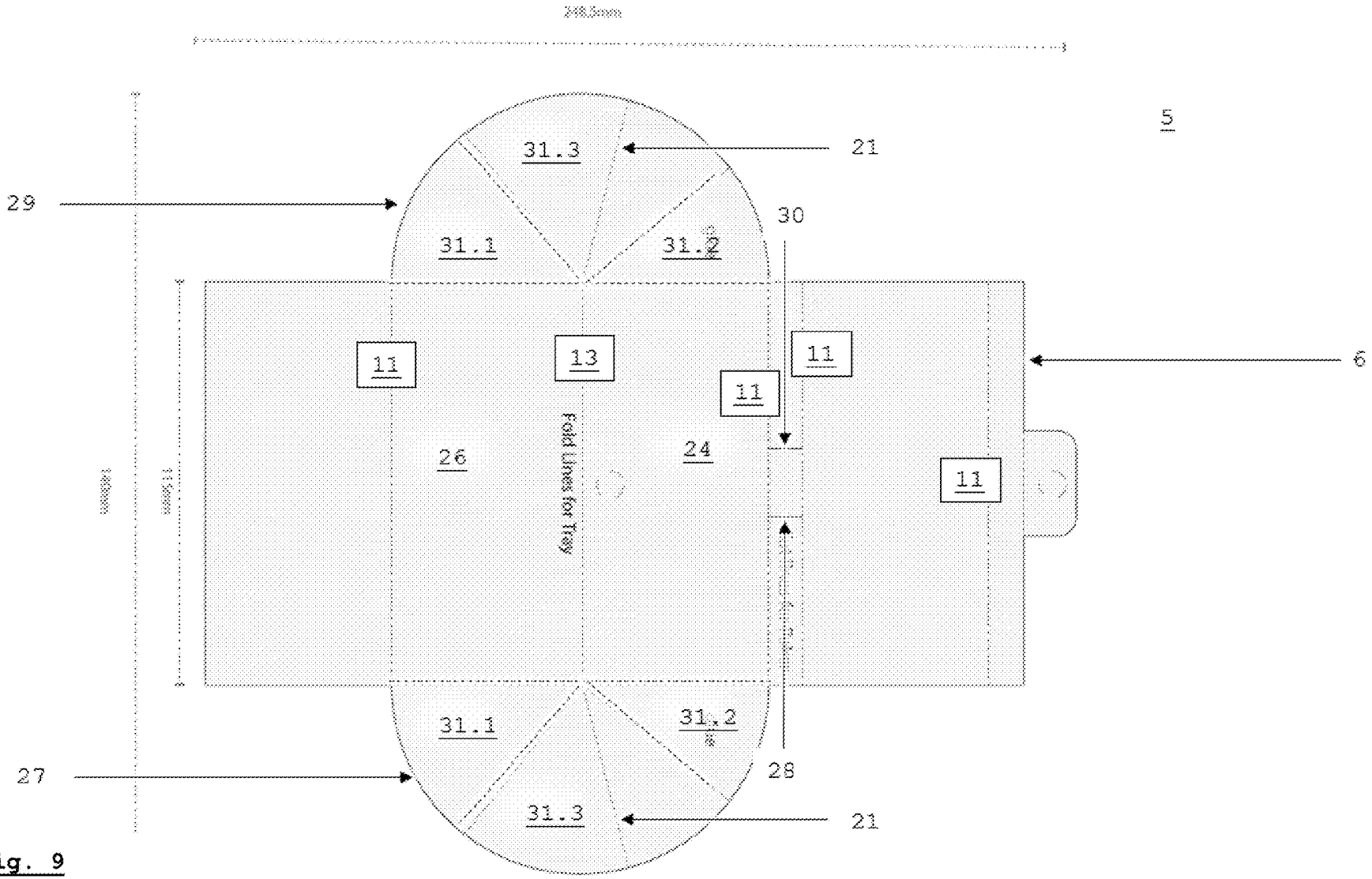
FIG. 9 shows a top view of the sheet of the cover body of the tray booklet according to the second embodiment.
Figure 11:
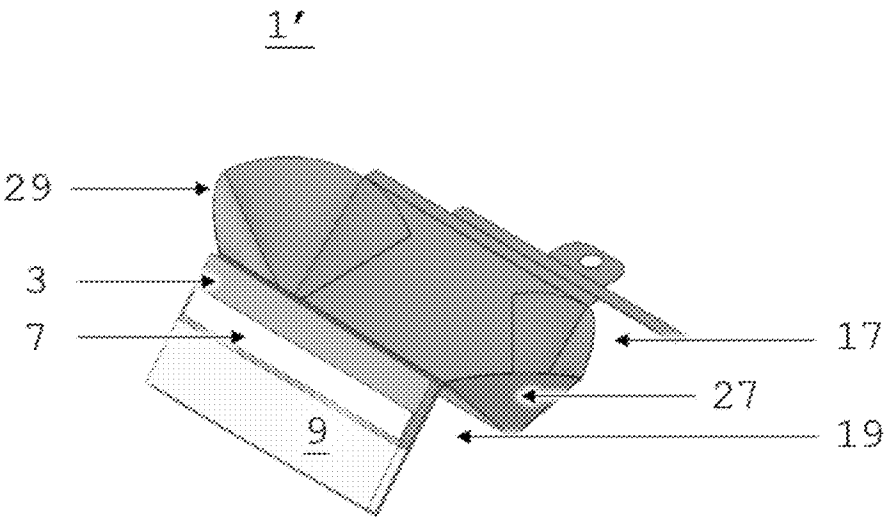
FIG. 11 shows a perspective view of the tray booklet, according to the second embodiment, in a tray configuration.
Figure 10:
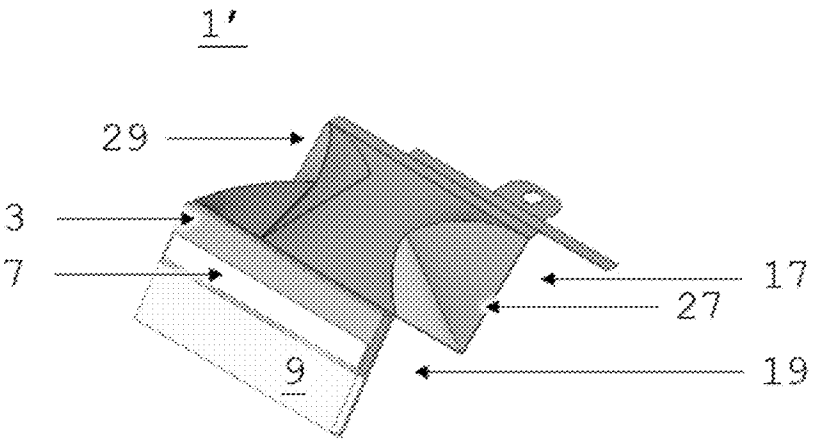
FIG. 10 shows a perspective view of the tray booklet, according to the second embodiment, in a channel configuration.

FIG. 9 shows that each of the two lateral flaps is formed as a semi-circle which is integral with the sheet 6. For each of the flap a first part 31.1 of the inner flap surface 31 is glued or otherwise affixed to the channel facing, also known as the inner facing, surface 26 of the first ondulation 17. A second part 31.2 of the inner flap surface 31 is glue or otherwise affixed to the channel facing, also known as the inner facing, surface 24 of the second ondulation 19. A third part of the 31.3 of the inner flap surface is unaffixed. FIG. 9 also shows that the two flaps 27, 29 are provided with third lines of weakness 21 for the body to fold along from the channel configuration into the tray configuration and vice versa. The third lines of weakness are provided in the third part of the 31.3 of the inner flap surface of each of the two flaps. The sheet 6 is 248.5 mm in length and 115 mm in width. The full circular diameter of the flaps as semi-circles is 25 mm. The channel configuration can be seen in FIG. 10, whereas the tray configuration can be seen in FIG. 11. In the tray configuration the two flaps extend away from each other for forming an upstanding walls to support the tray booklet such that the body is further supported against the collapsing of the volume defined between the ondulations 17, 19. FIG. 12A shows the body of the booklet in the open configuration.

It can be seen from FIG. 12A that the booklet can move from the channel configuration into the open configuration by folding the inner surfaces 24, 26 of the ondulations 17, 19 toward each other along the, at least one, second line of weakness 13.

Figure 12B:
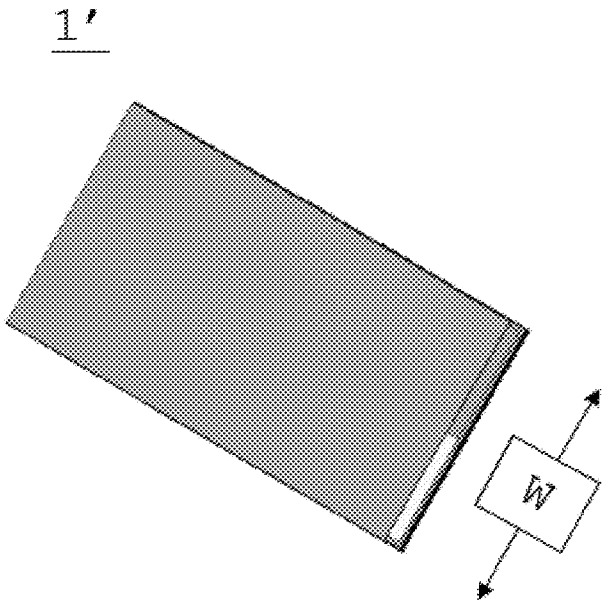
FIG. 12B shows a perspective view of a tray booklet, according to the second embodiment, in a closed configuration.
Figure 12A:
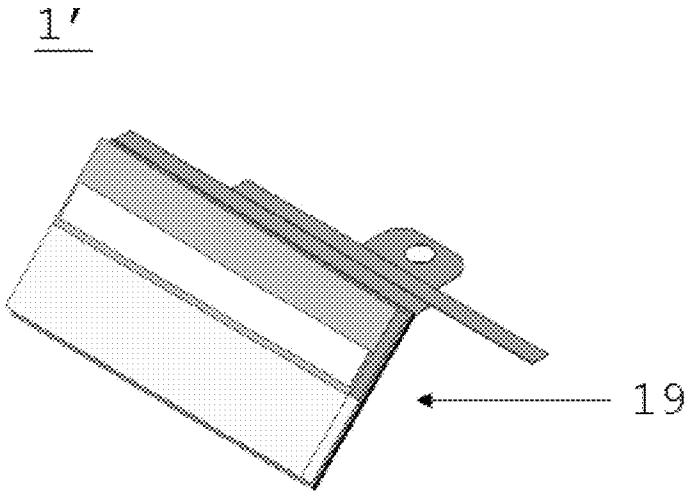
FIG. 12A shows a perspective view of a tray booklet, according to the second embodiment, in an open configuration.

FIG. 12B shows the booklet 1' in the closed configuration. It is noted that the flaps are merely present in this second embodiment for allowing the body to assume the tray configuration. A same booklet as per the second embodiment but without flaps would still be able to assume all configurations, but the tray configuration.

Figure 15:
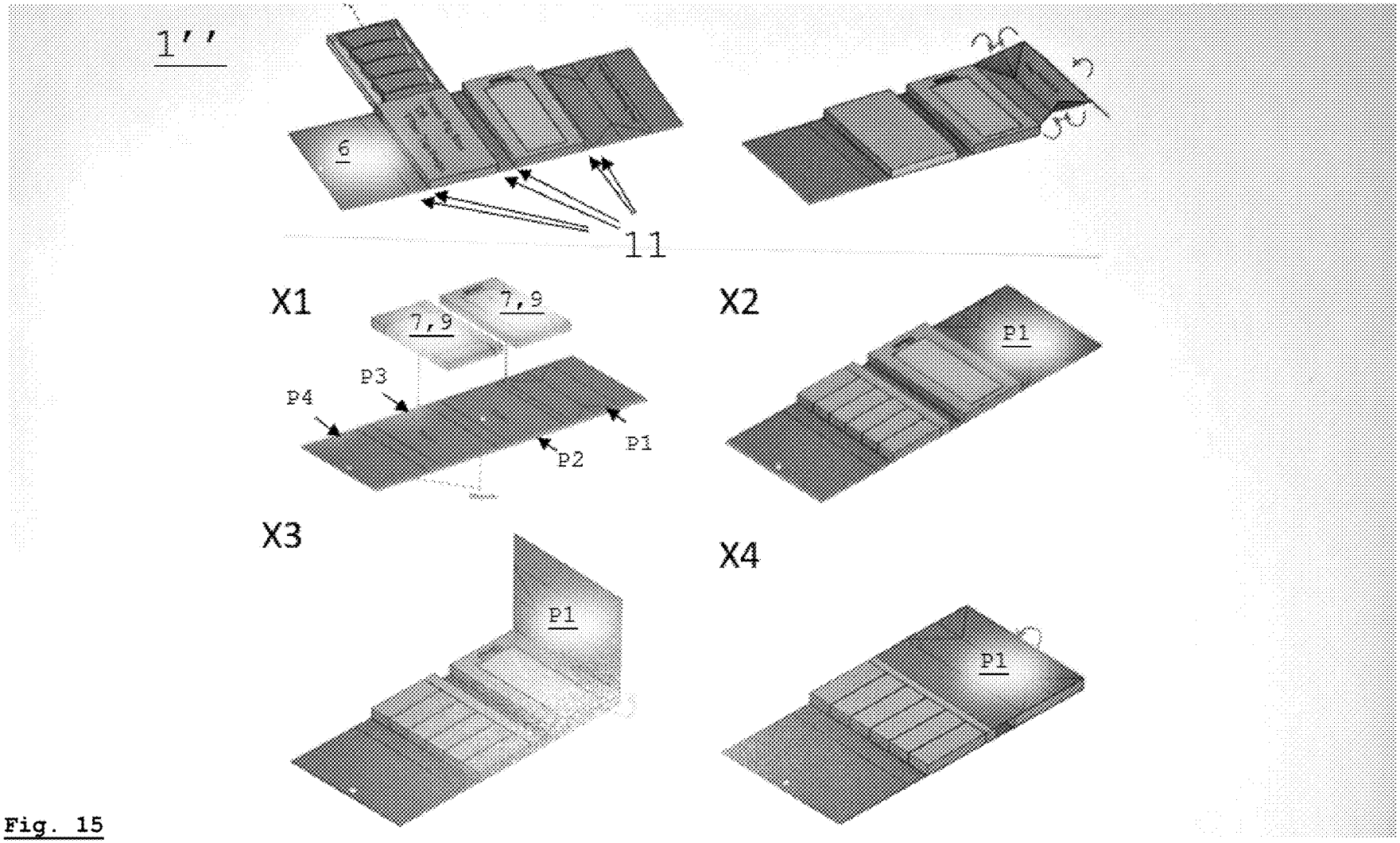
FIGS. 15 and 16 show a tray booklet according to a third embodiment in various folding arrangements.
Figure 16:
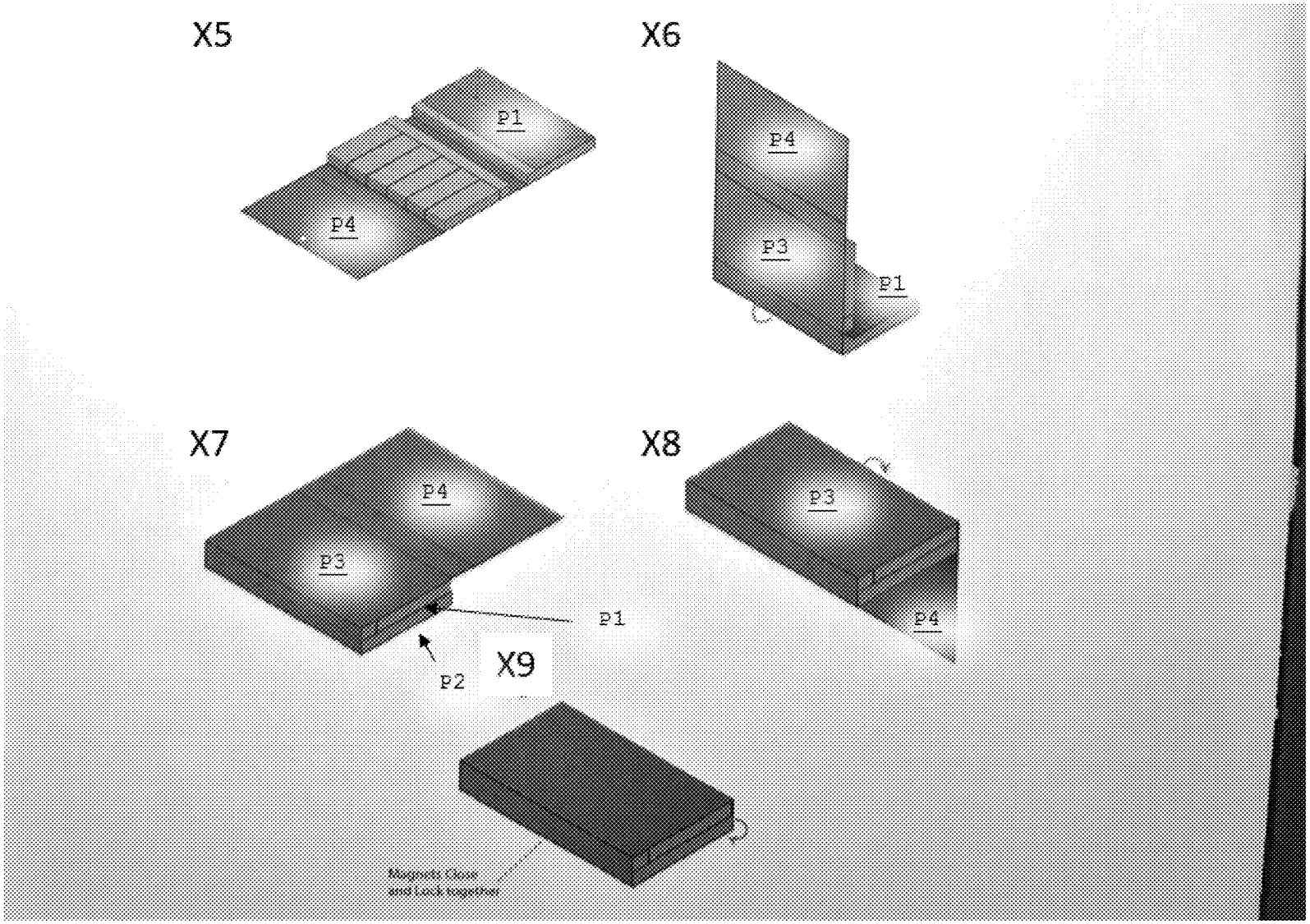

FIGS. 15 and 16 shows a tray booklet 1" for smokables (not shown, but customary) according to a third embodiment of the first aspect of the invention. Hereinafter only differences with the tray booklet 1 according to the first embodiment will be discussed. Features shared across the embodiments are provided with the same reference numbers. FIGS. 15 and 16 more specifically show the tray booklet 1" in a variety of arrangements from X2 open to closed X9 and all arrangements in between X3-X8. X1 shows that the booklet comprises a single flat piece of laminated cardboard with four distinct portions which are separated by pairs of parallel lines of weakness 11. Portion P1 can be folded into a tray as seen from FIGS. 1-7. Portion P2 is adjoined to portion P1 and comprises smoking paraphernalia 7, 9. In this example a rolling paper holder is glued onto the inner surface of portion P2 and comprises rolling papers. Portion P3 is adjoined to portion P2 and also comprises smoking paraphernalia 7, 9. In this example a filter tip box or filter tip page is glued onto the inner surface of portion P3. Portion P4 is adjoined to portion P3 and is a cover portion with a magnet. As shown in FIGS. 15 and 16 the booklet is closed by folding portion P1 over P2, subsequently folding portion P3 over P1 covering portion P2 and lastly folding portion P4 over portion over the rear of portion P3. Portions P3 and P4 comprises magnets so as to facilitate a magnetic closure. The lines of weakness as defined in the body of the booklet 1" are provided in parallel pairs, wherein the pair of lines between the portion P1 and P2 are twice as close together as the pair of lines between portion P2 and P3, and portion P3 and P4. In this example only one ondulation 19 is present. In the embodiment according to FIGS. 15 and 16 a stick element can also be present. The sheet of the booklet would in such a case comprises two slits extending in a perpendicular direction to the first lines of weakness, between the pair of first lines of weakness that separate portion P1 from portion P2. The stick element would then be secured to the body by simultaneously extending through the two slits, and wherein optionally each slit extends from one line of the first lines of weakness to another line of the first lines of weakness of the same pair. The smoking paraphernalia 7, 9 as shown in Figured 14 and 15 comprise rolling papers in a holder. In this example these can be ordinarily stacked rolling papers in a holder.

Figure 13B:
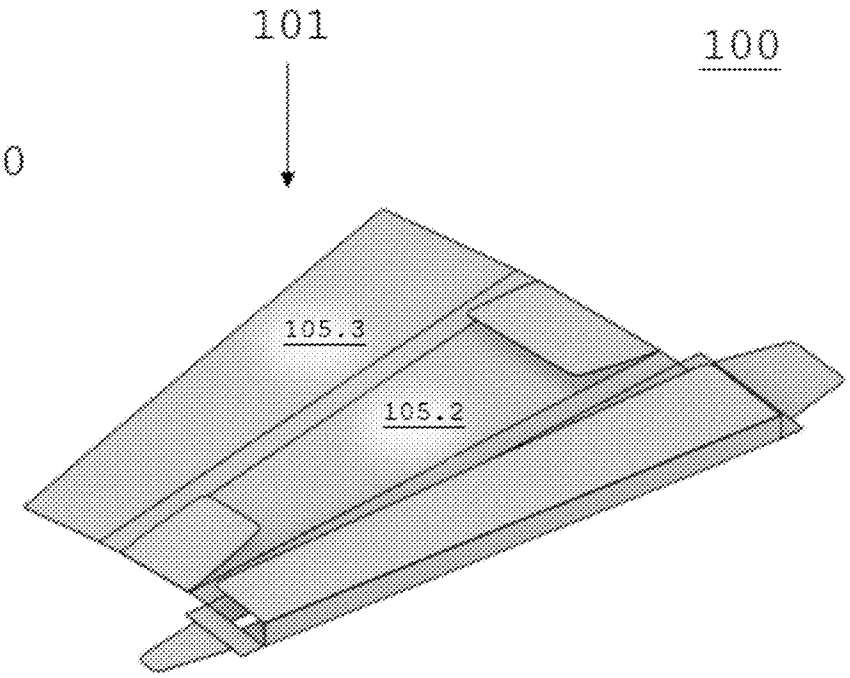
FIGS. 13A-13F are a series of figures showing a single sheet cutout in various stages of folding into a rolling paper holder.
Figure 13A:
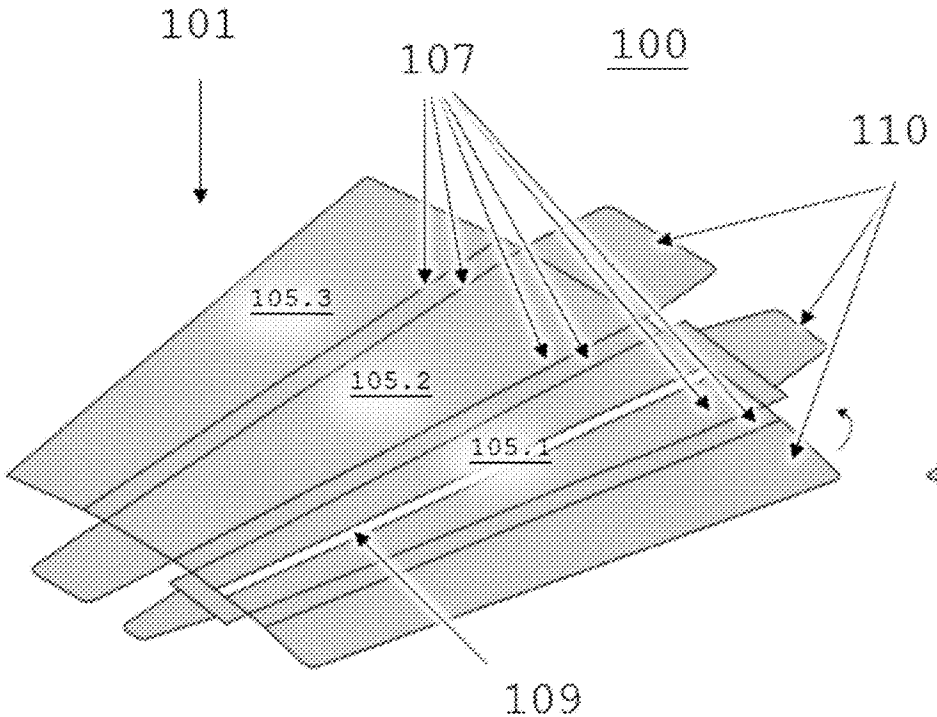
Figure 13D:
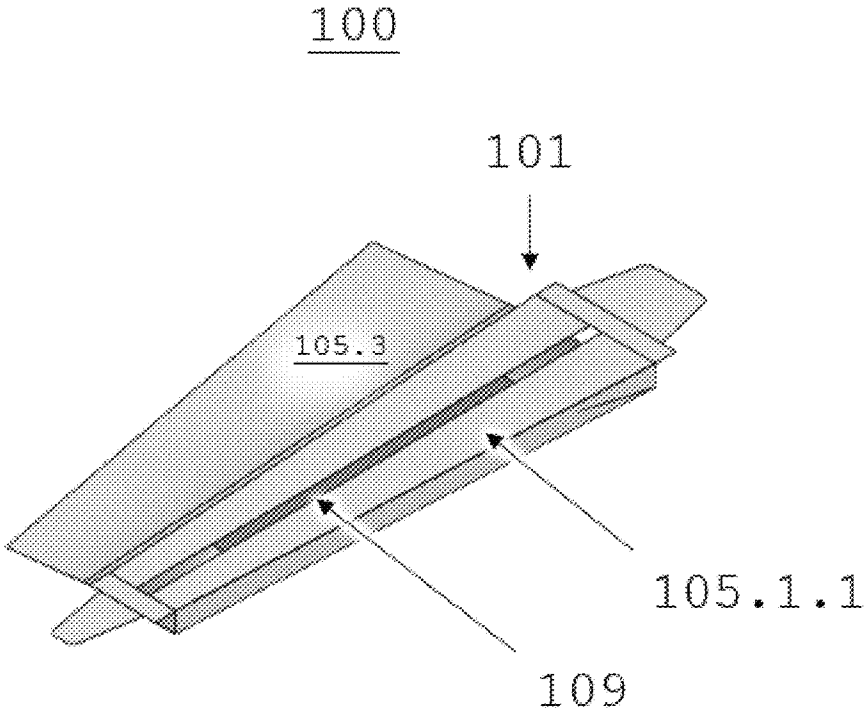
Figure 13C:
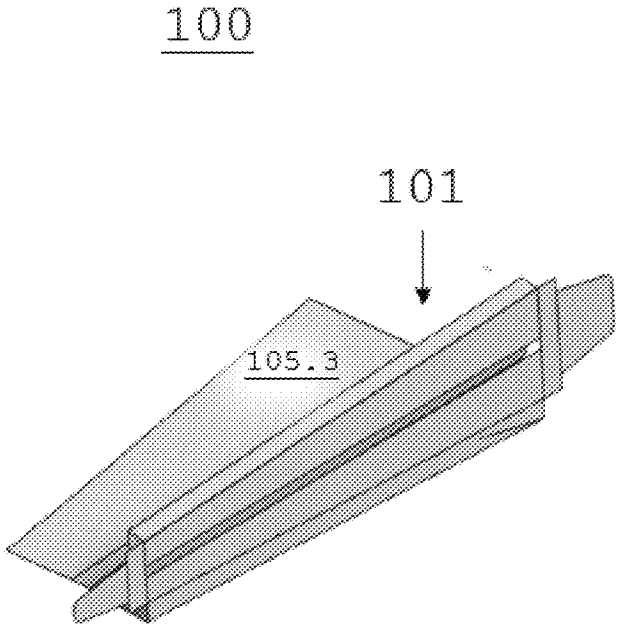
Figure 13E:
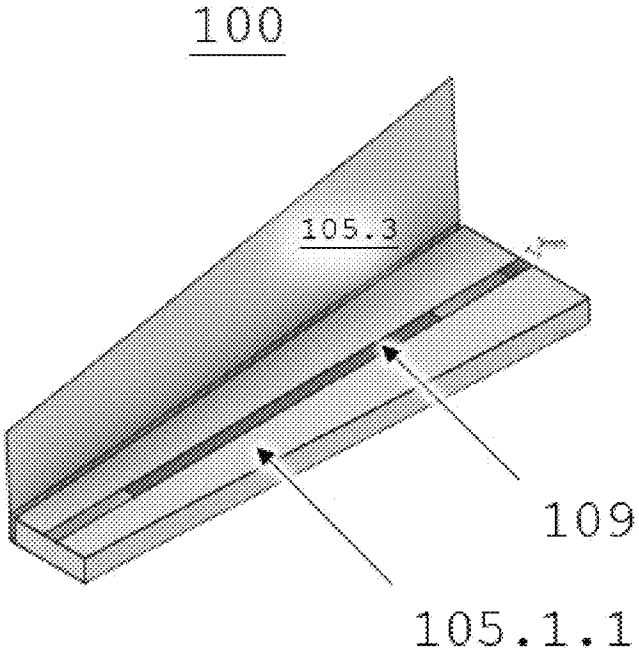
Figure 13F:
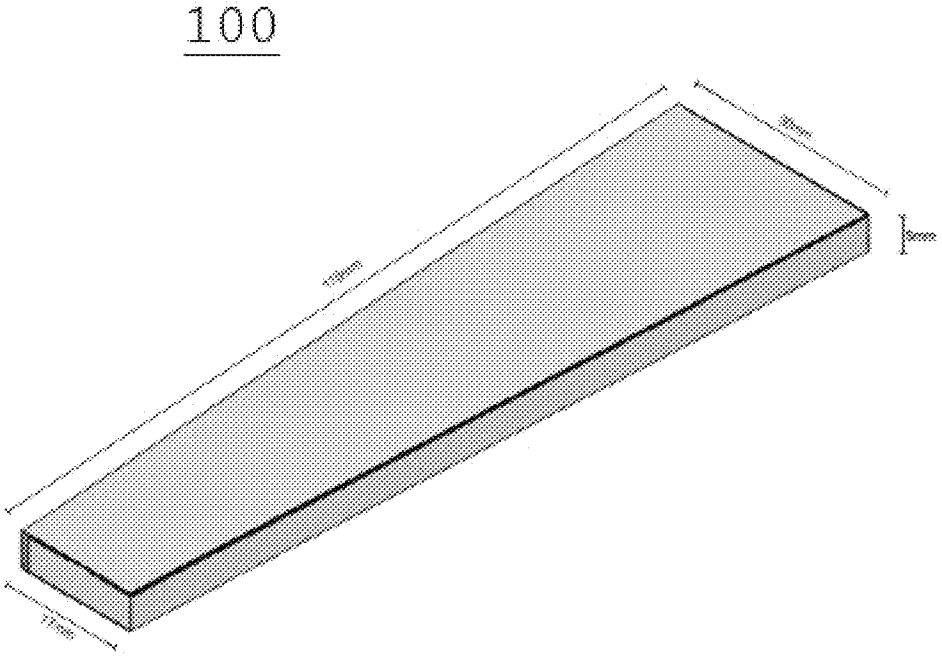

FIGS. 13E and 13F show a rolling paper holder 100 according to a second aspect of the invention, having been folded from a single sheet cutout 101 according to FIG. 13A to delimit an inner volume for holding trapezoid rolling papers (not shown, but customary) therein in a stack. FIGS. 13B, 13C and 13D show the holder in various different stages of being folded. The cutout 101 has lines of weakness 107 arranged such that they define a plurality of trapezoid areas 105.1, 105.2, 105.3 and along which lines of weakness 107 the cutout is folded into the holder 100. These lines of weakness 107 may be formed by creasing the cutout. The cutout can be made from a sheet paper, or cardboard or a laminate. One area of the plurality of trapezoid areas is an outlet area 105.1 provided with a slit 109 for allowing a rolling paper closest to the outlet area to be removed from the stack therethrough. In this example the slit is 3 mm. Another area of the plurality of trapezoid areas is a base area 105.2 which forms a base of the holder opposite the outlet area 105.1. In this example the plurality of trapezoid areas also comprises an optional trapezoid cover 105.3 arranged as a flap for reversibly covering an outer face 105.1.1 of the trapezoid outlet area 105.1. Each of the plurality of trapezoid areas has substantially equal dimensions. Each of the plurality of trapezoid has the following circumferential dimensions: 17 mm by 110 mm by 30 mm by 110 mm. The holder as seen in FIG. 13F has a height of 5 mm. FIG. 13A also shows the presence of folding flaps 110 outside besides the trapezoid areas.

Figure 17:
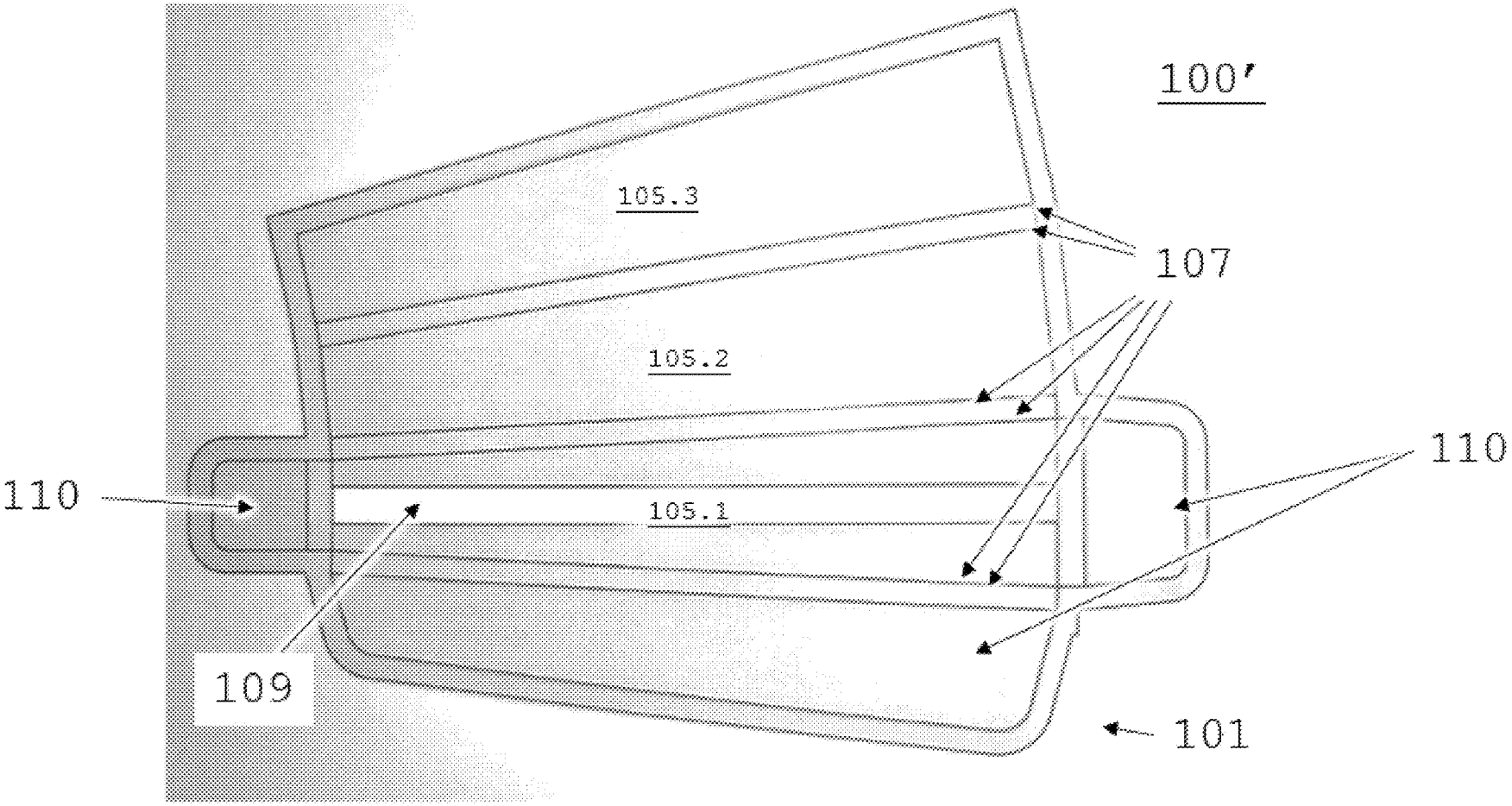
FIG. 17 shows a rolling paper holder according to an embodiment of the present invention.

FIG. 17 shows an alternative embodiment of a rolling paper holder 100' with respect to the rolling paper holder as shown in FIGS. 13A-13F. The holder differs in that only the outlet area 105.1 comprises folding flaps 110.

Figure 18:
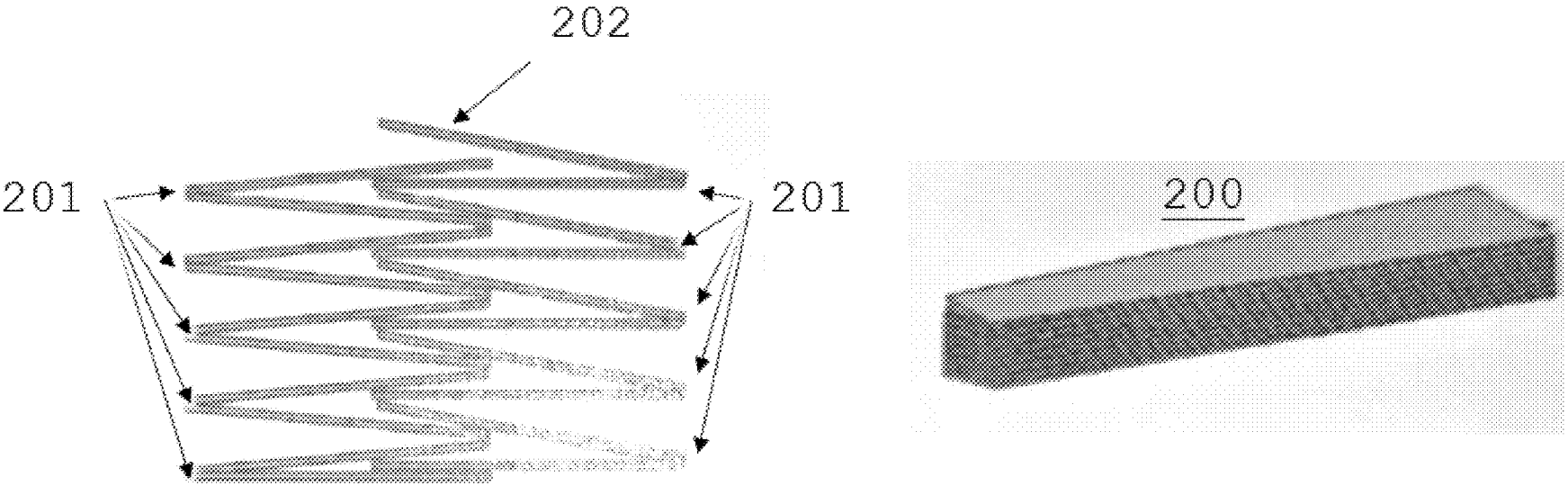
FIG. 18 shows a stack of rolling papers in both perspective and side views according to an embodiment of the present invention.

FIG. 18 shows a plurality of stacked plurality of trapezoid rolling papers 200, wherein each rolling paper of the plurality of rolling papers comprises a fold 201 along its length, and wherein the plurality rolling papers are interconnectedly stacked so that the removal of one rolling paper through the slit will pull a part of the subsequent rolling paper through the slit with it, such as up until its fold. These rolling papers are provided as a stack on top of trapezoidal area 105.1 so that a first paper of the stack 202 will partially reach through the slit. Subsequently, the holder is folded so as to envelope the stack.

According to a third aspect of the invention any of the tray booklets according to the first aspect of the invention can be assembled with a rolling paper holder according to the second aspect of the invention. To arrive at this third aspect of the invention the conventional holder 3 as shown in any of the embodiments according to the first aspect of the invention may be substituted with holder 100 according to a second aspect of the invention.

Accordingly, there is described herein an assembly of a tray booklet and rolling paper holder, the individual booklet and individual rolling paper holder. The booklet is suitable for smokables comprising a compostable cover body comprising a sheet defining an inner surface and an outer surface, and smoking paraphernalia arranged on the inner surface. The sheet is provided with first lines of weakness for the cover body to fold along from an open configuration into a closed configuration and vice versa. In the closed configuration the sheet encloses the smoking paraphernalia. In the open configuration the smoking paraphernalia are uncovered. The sheet is provided with at least one second line of weakness for the body to fold along from an open configuration into a channel configuration and vice versa. In the channel configuration the sheet forms a first and a second upstanding ondulation defining a holding channel therebetween for holding the smokables. The rolling paper holder is folded from a single sheet cutout such that the holder defines an inner volume for holding trapezoid rolling papers therein in a stack. The cutout comprises lines of weakness arranged such that they define a plurality of trapezoid areas and along which lines of weakness the cutout is folded into the holder. The plurality of trapezoid areas comprises a trapezoid outlet provided with a slit for allowing a rolling paper closest to the outlet area to be removed from the stack therethrough, and a trapezoid base forming a base of the holder opposite the trapezoid outlet area.

Note that in the specification and claims, "about" or "approximately" means within twenty percent (20%) of the numerical amount cited.

Although the invention has been discussed in the foregoing with reference to an exemplary embodiment of the method of the invention, the invention is not restricted to this particular embodiment which can be varied in many ways without departing from the invention. The discussed exemplary embodiment shall therefore not be used to construe the appended claims strictly in accordance therewith. On the contrary the embodiment is merely intended to explain the wording of the appended claims without intent to limit the claims to this exemplary embodiment. The scope of protection of the invention shall therefore be construed in accordance with the appended claims only, wherein a possible ambiguity in the wording of the claims shall be resolved using this exemplary embodiment.

Embodiments of the present invention can include every combination of features that are disclosed herein independently from each other. Although the invention has been described in detail with particular reference to the disclosed embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguration of their relationships with one another

What is claimed is:

1. A tray booklet for smokables comprising:

a compostable cover body comprising a sheet defining an inner surface and an outer surface; and smoking paraphernalia arranged on the inner surface, wherein the sheet comprises first lines of weakness for the cover body to fold along from an open configuration into a closed configuration and vice versa, wherein in the closed configuration the sheet encloses the smoking paraphernalia, and wherein in the open configuration the smoking paraphernalia are uncovered, wherein the sheet further comprises at least one second line of weakness for the body to fold along from an open configuration into a channel configuration and vice versa, and wherein in the channel configuration the sheet forms a first and a second upstanding ondulation defining a holding channel therebetween for holding the smokables, wherein the booklet further comprises a stick element, and wherein the sheet comprises two slits extending in a substantially perpendicular direction or any angle between 45-90 degrees to the first lines of weakness, and wherein the stick element is secured to the body by simultaneously extending through the two slits, and wherein each slit extends from one line of the first lines of weakness to another line of the first lines of weakness.

2. The booklet according to any of claim 1, wherein each of the first and second upstanding ondulations is triangular.

3. The booklet according to claim 1, wherein the holding channel is an inverted trapezoid or V-shaped in its medial cross-section (A-A).

4. The booklet according to claim 1, further comprising a magnetic seal, for reversibly securing the cover body in the closed position.

5. The booklet according claim 1, wherein in the open position the first lines of weakness and the at least one second line of weakness are substantially parallel to each other in 3D space and distributed along the inner and/or outer surface of the sheet.

6. The booklet according to claim 1, wherein the smoking paraphernalia comprise at least one of filters and rolling papers, and wherein the rolling papers comprise a stack of trapezoid rolling papers in a holder.

7. The booklet according to claim 1, wherein the sheet is further provided with third lines of weakness for the body to fold along from the channel configuration into a tray configuration and vice versa, wherein in the tray configuration opposite ends of the holding channel each form an upstanding wall.

8. The booklet according to claim 7, wherein the length of the opposite ends of the holding channel are chosen such that each of their lengths is substantially half the width (W) of the tray booklet, and wherein each is less than half of the total length of the holding channel.

9. The booklet according to claim 1, wherein the body further comprises two lateral flaps each defining an inner flap surface and an outer flap surface, wherein each of the two lateral flaps is integral with the sheet, and wherein for each flap a first part of the inner flap surface is affixed, such as by glue, to a channel facing surface of the first ondulation, and wherein for a second part of the inner flap surface is affixed, such as by glue, to a channel facing surface of the second ondulation, and wherein a third part of the of the inner flap surface is unaffixed, wherein the two flaps are provided with third lines of weakness for the body to fold along from the channel configuration into a tray configuration and vice versa, and wherein in the tray configuration the two flaps extend away from each other for forming an upstanding wall.

10. The booklet according to claim 9, wherein each of the two flaps comprises a semi-circle shape.

11. The booklet according to claim 9, wherein the third lines of weakness are disposed in the third part of the of the inner flap surface of each of the two flaps.

12. The tray booklet according to claim 1 further comprising a rolling paper holder folded from a single sheet cutout such that the holder defines an inner volume for holding trapezoid rolling papers therein in a stack, wherein the cutout comprises lines of weakness arranged such that they define a plurality of trapezoid areas and along which lines of weakness the cutout is folded into the holder, wherein the plurality of trapezoid areas comprises:

a trapezoid outlet area provided with a slit for allowing a rolling paper closest to the outlet area to be removed from the stack therethrough; and a trapezoid base area forming a base of the holder opposite the trapezoid outlet area.

13. The tray booklet according to claim 12, wherein the sheet is further provided with third lines of weakness for the body to fold along from the channel configuration into a tray configuration and vice versa, wherein in the tray configuration opposite ends of the holding channel each form an upstanding wall.

* * * * *